United States Patent [19]

Cuppleditch et al.

[11] 4,273,254

[45] Jun. 16, 1981

[54] DEVICE FOR CONTAINING AND DISPENSING PARTICLES SUCH AS TABLETS

[76] Inventors: Brian Cuppleditch, 16 Devonshire Ave., Bryanston, Sandton, Transvaal; Clive Lewis, 99 Packard St., Woodmead, Sandton, Transvaal, both of South Africa

[21] Appl. No.: 5,886

[22] Filed: Jan. 23, 1979

[51] Int. Cl.[3] ..... B65D 83/04

[52] U.S. Cl. ..... 221/196; 221/265

[58] Field of Search ..... 221/265, 196, 195, 194; 222/370, 254, 264, 273, 274, 284; 206/540

[56] References Cited

U.S. PATENT DOCUMENTS

| | | | |
|---|---|---|---|
| 2,750,072 | 6/1956 | Duncan | 222/370 X |
| 3,730,387 | 5/1973 | McConnell et al. | 221/265 |
| 3,991,908 | 11/1976 | Thomas et al. | 221/265 X |

FOREIGN PATENT DOCUMENTS

| | | | |
|---|---|---|---|
| 2615423 | 10/1977 | Fed. Rep. of Germany | 221/265 |
| 1112962 | 3/1956 | France | 221/196 |

*Primary Examiner*—F. J. Bartuska

*Attorney, Agent, or Firm*—Ladas & Parry

[57] ABSTRACT

A container-dispenser for particles such as tablets for medical use consists of a chamber with a rotary floor, a cone-like protrusion in the center of the floor causing spreading of the particles in the chamber, an aperture in the floor which a predetermined quantity of the particles may enter and travel along in the chamber, and a fixed diaphragm below the floor with an aperture which registers with the aperture in the floor in one position of the floor. The particles pass in this position of register into the diaphragm and thence into a receiver, preferably a spiral chute. An apertured disc may be provided below the diaphragm to rotate with the floor, its aperture being out of register with that in the floor, to ensure complete consistency of delivery.

7 Claims, 3 Drawing Figures

DEVICE FOR CONTAINING AND DISPENSING PARTICLES SUCH AS TABLETS

BACKGROUND OF THE INVENTION

This invention relates to a combined container and dispenser for particles such as tablets used medically for numerous therapeutic and prophylactic purposes.

In modern medicine many types of tablets must be taken at regular intervals over a considerable period. The storage, transportation and dispensing of these tablets presents the patient with a considerable problem if he receives the tablets merely in a conventional container (such as a box or bottle) from his pharmacist. Among the drawbacks of these conventional containers are the facts that the tablets are exposed on opening the container, and that they tend to receive more handling than is desirable. It is also sometimes difficult for the patient to extract the tablets one at a time, particularly if they are small or if the patient is a child or a person who suffers from a disability impairing his mechanical dexterity.

Some forms of modern packaging, such as blister wrapping and the packing of tablets in rolls, go some way to improve the position, but not all tablets, and particularly small tablets to be taken regularly over a lengthy period, are suitable for this type of approach. Blister and roll packages also suffer from certain inherent defects, among them a relatively low resistance to handling and, at least in the case of blister wrapping, a lack of compactness.

SUMMARY OF THE INVENTION

It is an object of the invention to provide a combined container and dispenser for particles such as tablets which is useful in solving or mitigating the problems outlined above, and particularly to provide a container-dispenser which is sturdy and durable, which allows even small particles to be dispensed without difficulty in measured quantities or even singly by persons with a low degree of mechanical dexterity, and which is nevertheless sufficiently simple to be used as the original container in which a manufacturer may pack his products in the quantities likely to be useful to the consumer.

While such a container is particularly useful for medical products its scope extends also to further industries such as agriculture, confectionery and many others.

According to the invention a container-dispenser for particles comprises a housing defining a chamber of which at least a part is generally cylindrical, a circular floor mounted rotatably in the generally cylindrical part of the chamber and having centrally on its upper surface an upwardly narrowing protrusion, the floor being formed with an aperture adapted to receive a measured quantity of the particles from a supply of the particles located in the chamber, a diaphragm located in the chamber below the floor and being formed with an aperture adapted, in one position of the floor relatively to the housing, to register with the aperture in the floor, means to rotate the floor and its protrusion in the chamber relatively to the housing, and receiving means located below the diaphragm to receive a measured quantity of the particles which has been transferred, on such rotation, through the aperture in the floor to the aperture in the diaphragm and thence to the receiving means.

In a preferred form the protrusion is generally conical and the means to rotate the floor and the protrusion is a rod attached to and extending upwards from the protrusion and passing through a roof of the housing, a knob being attached to the upper end of the rod for gripping by the user.

The receiving means may conveniently be a chute into which the measured quantity of particles is delivered, preferably a generally spiral chute extending round the lower part of the housing.

If the container-dispenser is to be used for delivering single disc-shaped particles such as tablets, it is preferred that the apertures in the floor and the diaphragm be of a shape such that they will receive only a tablet which is positioned with its sides upright and which sides are generally parallel to a tangent to the floor at the point where the aperture in the floor is located. The protrusion on the floor in this case preferably extends radially to a distance from the surrounding wall of the chamber less than the diameter of the disc-shaped tablet, so that the tablets are encouraged, on rotation of the floor and the protrusion, to take up a position on the protrusion such that they drop easily in the correct orientation into the aperture in the floor.

In a preferred version there is also, below the diaphragm, a disc which is of substantially the same diameter as the floor and which is arranged to rotate with the floor and the protrusion. The disc carries an aperture which is so located as to register in one position of the disc with the aperture in the diaphragm, the aperture in the floor being in this position out of register with the aperture in the diaphragm. The presence of the disc ensures consistency in the delivery of the particles, even if rotation of the floor should cease while the apertures in the floor and the diaphragm are in register.

There may also be more than one aperture in the floor, in which case, if a disc below the diaphragm is provided, there will be a corresponding number of apertures in the disc. This arrangement ensures that for every complete revolution of the floor and its protrusion, the number of measured doses of the particles delivered to the receiving means will equal the number of apertures in the floor. For use of the container-dispenser in so-called compliance medication, two apertures in the floor will normally suffice.

DESCRIPTION OF A PREFERRED EMBODIMENT

Figure 1:
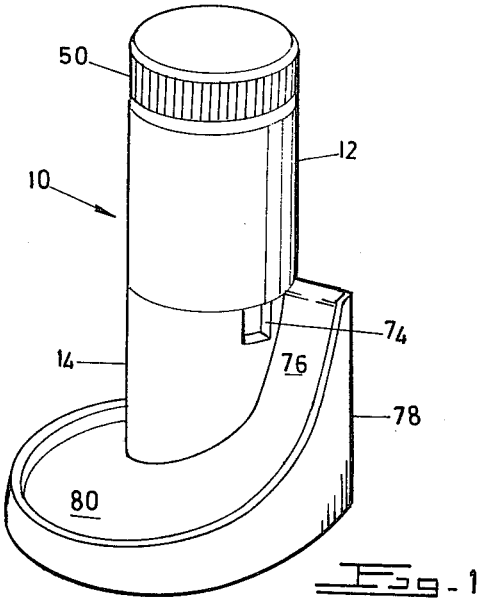
FIG. 1 is a perspective view of a dispenser-container of the invention.

In the drawings, a container-dispenser 10 for small tablets comprises a cylindrical housing in two parts 12, 14. The upper edge of the lower housing part 14 is stepped at 16 to leave an annular protrusion 18 which is a press fit in the base of the upper housing part 12.

Figure 2:
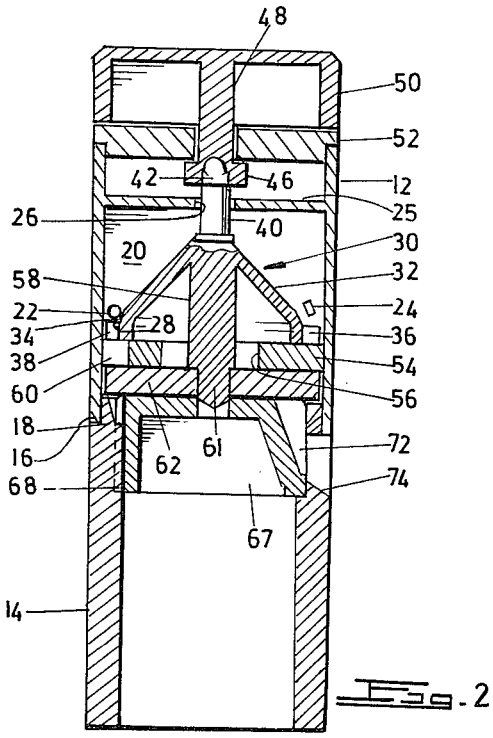
FIG. 2 is a sectioned elevation view of the container-dispenser of FIG. 1, with a surrounding spiral chute removed.
Figure 3:
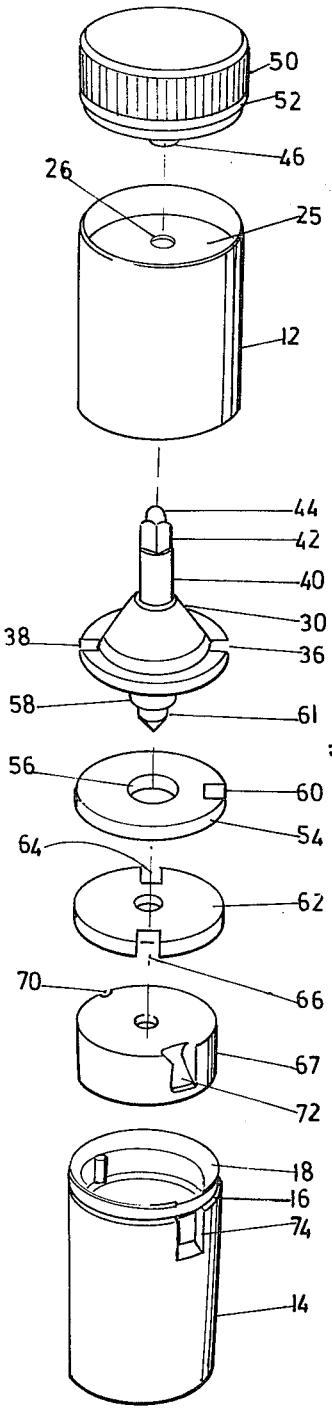
FIG. 3 is an exploded perspective view of the structure of FIG. 2.

The lower interior portion of the upper housing part 12 forms a cylindrical chamber 20 which is adapted to be filled with tablets, of which only two, 22 and 24, are seen in FIG. 2. In practice the chamber 20 will be packed originally with a far larger number of tablets.

The chamber has a roof 25 formed integrally with the housing part 12 and which is centrally pierced at 26.

Also located in the chamber 20 and rotatable in it is a circular floor 28 on which, centrally positioned, is an upwardly narrowing protrusion in the form of a generally conical body 30. In this embodiment the conical body has an upper part 32 of a relatively low slope and a lower part 34 of a relatively sharp slope, the part 34 joining the floor 28. An aperture 36 is formed in the floor 28 at a point in its periphery radially outward of the protrusion 30, a second aperture 38 being formed on the opposite side of the floor along the same diameter. The apertures 36,38 are of such a size that they will accommodate a tablet in the position of that numbered 24, namely with the sides of the tablet located upright and generally parallel to a tangent to the floor 28 at the points of such apertures; but the apertures will not accommodate a tablet in the position of the tablet 22, namely one whose sides are upright but which extend generally radially with respect to the floor. Note also that the protrusion 30 is of such a size that tablets in the position of that numbered 22 cannot touch the floor 28. The effect of this construction is that, on rotation of the floor 28 and the protrusion 30 in the chamber, tablets filling the chamber will tend to move into the position of that numbered 24, and those in the position of that numbered 22 will be moved through 90° to enable them to attain the position of the tablet 24 and hence drop into the aperture 36 or 38 when such aperture presents itself below the tablet in question and is empty.

The floor 28 and protrusion 30 are permanently fixed to a rod 40 which extends through the hole 26 in the roof 25 of the housing part 12 and has near its end a portion 42 which is square section, surmounted by a dome 44. The square-sectioned portion 42 is received as a tight fit in a boss 46 at the end of a stalk 48 which extends downward from the undersurface of a knurled knob 50. Surrounding the stalk 48 with a slight clearance is a bearing 52 with a stepped edge which seats as a press fit in the upper end of the housing part 12, ensuring that the knob 50 is firmly supported in the overall structure and is properly centered.

Below the floor 28 is a circular diaphragm 54 which is a press fit in the interior of the chamber 20 and which has a central aperture 56 through which a thickened lower end 58 of the rod 40 passes. The diaphragm 54 is of a marginally greater thickness than the diameter of a tablet 22,24, and is formed at a point on its periphery with an aperture 60 of substantially the same width as the apertures 36,38 in the floor 28. The diaphragm 54 does not rotate in the chamber 20 on rotation of the floor 28 and protrusion 30.

Fixed as a press fit on a narrowed end 61 of the rod 40,58 is a disc 62 of substantially the same thickness as the diaphragm 54. The disc 62 rotates with the knob 50, rod 40,58, floor 28 and protrusion 30. At two opposite points on its periphery the disc 62 is formed with apertures 64,66 which are out of register from the apertures 36,38 in the floor 28 and which are of substantially the same size as the aperture 60 in the diaphragm 54.

The upper interior portion of the lower housing part 14 accommodates a cap 67 which is located by means of a key 68 on the housing part 14 in a keyway 70 in the cap 67 and which has, as a suitable point on its periphery, a recess 72 which registers with a mouth 74 formed in the lower housing part 14 at its upper edge. The mouth 74 is at the head of a spiral chute 76 formed in a body 78 which surrounds the lower housing part 14 and is a press fit on it. The chute 78 ends in a basin-like zone 80 in which a tablet delivered down the chute 76 will come to rest and be easily accessible to the fingers of the user. As FIG. 1 shows, the chute 76 includes an outer wall extending around a substantial part of the container-dispenser, the base of this wall defining the radially outer part or perimeter of the base of the container-dispenser.

All the components of the container-dispenser described above are conveniently moulded from plastics. For extra security, labels attached to the exterior parts may straddle press-fit joints and so reinforce the assembly.

The operation of the container-dispenser will be clear from what has been said above. The chamber 20 will be factory-filled with tablets. When the user acquires the container-dispenser, he has merely to rotate the knob 50. This causes rotation through the stalk 48 and the rod 40,58 of the conical protrusion 30 and the floor 28 of the chamber. The effect of this rotation, in the cylindrical geometry of the housing, causes the tablets to spread without jamming over the conical body 30. In the lowermost portion of the chamber 20 the tablets orient themselves in the position of the tablet 24 along the floor 28. When one of the apertures 36,38 is open, a tablet drops into it and rotates with the floor 28 until it reaches the aperture 60 in the fixed diaphragm 54. It drops into the aperture 60 in the diaphragm 54 and remains there until one of the apertures 64,66 in the disc 62 passes below it. At this stage the tablet is transferred into such aperture 64,66 in the disc 62. When this aperture 64,66 next passes the recess 72 in the cap 67, the tablet falls into this recess and leaves the housing part 14 through the mouth 74. It slides down the chute 76 and comes to rest in the basin zone 80, where the user can lift it with his fingers. The cycle repeats itself with each passage of an aperture 36,38 in the floor 28 past the position of registration with the aperture 60 in the diaphragm 54.

Note that the floor 28 is of a thickness slightly less than the diameter of a tablet 22,24. This means that, when a tablet enters an aperture 36,38, it will tend to lift tablets located directly above in the chamber 20 as the floor rotates past these tablets. This action helps to disperse the tablets and allow them to gravitate individually into the positions in which they can be taken up in an aperture 36,38 on later actuation of the knob 50.

ALTERNATIVE EMBODIMENTS

While the embodiment described above is devoted to a device for dispensing small tablets one at a time, it could with minor adaptations be used for dispensing several particles (such as grains) simultaneously. These adaptations concern chiefly the need to prevent loose particles from escaping into the spaces between the moving parts and tending to cause jamming.

We claim:

1. A container-dispenser for particles comprising a housing having walls defining a chamber in which at least a part is generally cylindrical, a circular floor mounted rotatably in the generally cylindrical part of the chamber and having centrally on its upper surface an upwardly narrowing protrusion, the floor being formed with an aperture adapted to receive a measured quantity of the particles from a supply of the particles located in the chamber, a diaphragm located in the chamber below the floor and being formed with an aperture adapted, in one position of the floor relatively to the housing, to register with the aperture in the floor, means to rotate the floor and its protrusion in the chamber relatively to the housing, a particle delivery opening in said housing walls below said diaphragm, and receiving means located below the diaphragm to receive a measured quantity of the particles which has been transferred, on such rotation, through the aperture in the floor to the aperture in the diaphragm and thence to the receiving means, the receiving means comprising a body surrounding a substantial portion of the lower portion of said housing, said body having a chute extending generally spirally around the housing with the head of the spiral chute disposed adjacent said delivery opening and said chute ending in a basin-like zone extending away from the walls of the housing and in which the measured quantity of the particles will come to rest to assure easy access to such particles by a user.

2. The container-dispenser of claim 1 in which the protrusion is generally conical.

3. The container-dispenser of claim 1 including a disc located below the diaphragm and mounted for rotary movement with the floor, the disc having an aperture which is out of register with the aperture in the floor but which is adapted, in one position of the disc relatively to the diaphragm, to register with the aperture in the diaphragm.

4. The container-dispenser of claim 1 in which the chute includes an outer wall extending around the lower part of the housing, the base of this wall defining the outer perimeter of the base of the container-dispenser.

5. The container-dispenser of claim 1 in which there are not more than two apertures in the floor of the housing to receive the particles.

6. The container-dispenser of claim 3 in which the chute includes an outer wall extending around the lower part of the housing, the base of this wall defining the outer perimeter of the base of the container-dispenser.

7. The container-dispenser of claim 3 in which there are not more than two apertures in the floor of the housing to receive the particles.

* * * * *